United States Patent [19]

Archibald

[11] 3,959,837

[45] June 1, 1976

[54] DINGHY WITH MAST WELL

[76] Inventor: Robert W. Archibald, 1500 S. 20th Ave., Hollywood, Fla. 33020

[22] Filed: Apr. 28, 1975

[21] Appl. No.: 572,485

[52] U.S. Cl. ..... 9/2 R; 114/39

[51] Int. Cl.[2] ..... B63B 35/00

[58] Field of Search ..... 114/39, 127–143; 9/1, 2 R

[56] References Cited

UNITED STATES PATENTS

| | | | |
|---|---|---|---|
| 1,093,475 | 4/1914 | Rosing | 9/1 |
| 2,248,307 | 7/1941 | Richards et al. | 9/1 |
| 2,319,132 | 5/1943 | Hood | 114/123 |
| 2,698,447 | 1/1955 | Potts et al. | 9/2 |
| 3,008,442 | 11/1961 | Russell | 114/39 |
| 3,090,974 | 5/1963 | Wozniak | 9/1 |
| 3,166,315 | 1/1965 | Jewett | 272/66 |
| 3,185,125 | 5/1965 | Haman | 115/26.3 |
| 3,373,715 | 3/1968 | Stacey | 115/70 |
| 3,634,897 | 1/1972 | Cussio | 9/1 R |
| D153,910 | 5/1947 | Williamson | D12/62 |
| D184,938 | 4/1959 | Hupp | D12/62 |
| D189,273 | 11/1960 | Seeman | D34/42 |

*Primary Examiner*—Trygve M. Blix
*Assistant Examiner*—Gregory W. O'Connor
*Attorney, Agent, or Firm*—Jones, Tullar & Cooper

[57] ABSTRACT

A small dinghy or pram having an elongated mast receiving well or slot is disclosed. The dinghy is intended to be stowed on the deck of a larger sailboat with the larger boat's mast being received in the dinghy's mast well, thus enabling the dinghy, to in effect, surround the mast and thereby effect the stowage of the dinghy on the deck of the sailboat in a manner which takes up a minimum of deck space. The inwardly extending slot may originate at the bow or stern of the dinghy or may alternately extend inwardly from either side. A removable plug is insertable into the dinghy's mast receiving well and is held therein by suitable means so that the dinghy will have its conventional bottom structure when the plug is in place. The plug may be provided with a mast step and dagger board well if desired.

10 Claims, 1 Drawing Figure

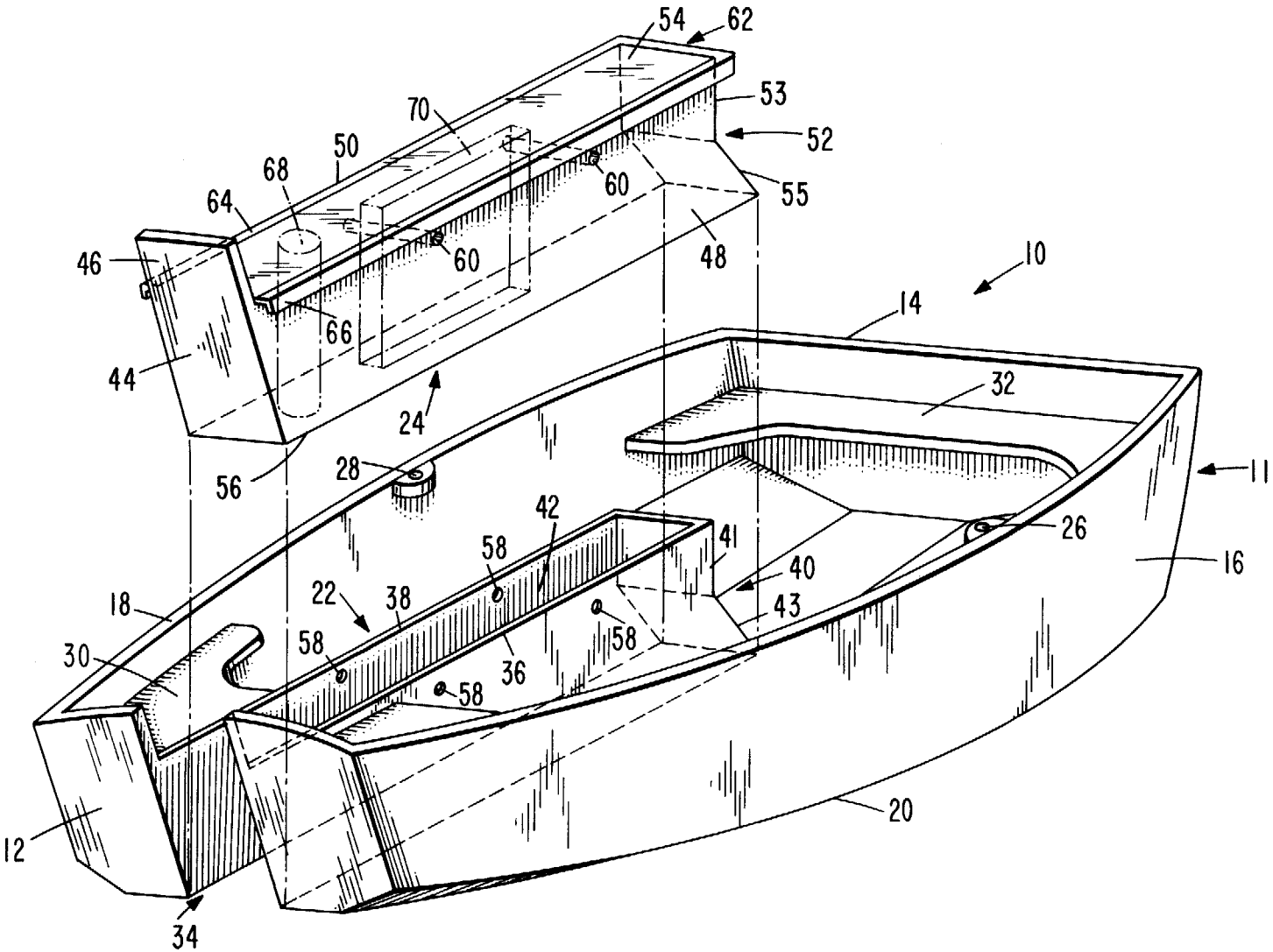
10
11
12
14
16
18
20
22
24
26
28
30
32
34
36
38
40
41
42
43
44
46
48
50
52
53
54
55
56
58
60
62
64
66
68
70

DINGHY WITH MAST WELL

FIELD OF THE INVENTION

The present invention is directed generally to a small dinghy or pram. More particularly, the present invention is directed to a dinghy or pram which is provided with means to facilitate its storage aboard a larger sailboat. Specifically, the present invention is directed to a pram or dinghy which is provided with a slot or mast receiving well and an interfitting plug whereby, upon removal of the plug, the dinghy may be carried on the deck of the larger sailboat with the sailboat's mast being received in the mast well or slot of the dinghy.

The dinghy or pram of the present invention has an open, walled slot or mast receiving well which extends from an exterior side of the dinghy into its interior. In a general sense, the boat has a generally U shape so that the mast of a large sailboat, upon which the dinghy is carried, will pass through the interior of the U. In this way, the dinghy may be carried aboard the sailboat in a manner which takes up little deck space. A removable plug is provided, and fits into the slot or mast well and is securable therein. When the dinghy is to be used, the plug is placed in the mast well to restore the bottom of the boat to a conventional configuration and to close off the mast well to eliminate the possibility of water entering the dinghy through the well. The plug may include a mast step and dagger board well so that the dinghy itself may be used for sailing if desired.

DESCRIPTION OF THE PRIOR ART

Every owner of a sailboat in the range of 18 to 36 or 40 feet or thereabout has, at one time or another, probably felt that it would be desireable to take a small dinghy or pram along when going on a sailing cruise. The uses for such a dinghy are many and range from going ashore to obtain supplies at locations where a suitable dock or pier is not available through reconnoitering shoal water ahead of the path of the sailboat to use of the dinghy in an emergency situation as a lifeboat. As the need or desirabilities for having such a dinghy with one while out on a cruise is recognized, so is the problem of how best to accomplish this objective.

In the past, there have been several alternative ways of bringing the dinghy or pram along on cruise. The dinghy may be pulled aboard the larger boat and stowed on the deck, usually at the bow. This is unacceptable for several reasons. The stowage of the dinghy in this manner is difficult as there is little room on the bow of a sailboat of the 18 to 36 or 40 foot size. Additionally, the stowage of the dinghy here interferes with the operation of the jib.

On a larger boat, the dinghy can'be suspended over the stern on davits, or can be placed aboard the boat along its side. Neither of these solutions are satisfactory on a sailboat of the size generally as set forth above. There is no room at the stern for the rigging of davits without their interference with the sailboat's boom, lines, and often its tiller. Also, stowage on the walkway along the boat's side is also impractical from the standpoint of available space.

The prior alternative method of bring the dinghy or pram along has been to tow it behind the sailboat at the end of a length of line. This procedure is equally unsatisfactory. The line used for towing the dinghy may either part or come untied. Either of these occurrances results at least in the inconvenience of retrieving the drifting dinghy, and may result in the permanent loss of the dinghy if the parting of the boat and dinghy is not discovered soon after its occurrance. The line tied from the stern of the sailboat may also foul in the boat's rudder or, if the boat is under the power of its auxiliary engine, in the engine's propellor. Either of these happenings is dangerous as well as an inconvenience.

If the sailboat is going with the waves; i.e. has a trailing sea, the dinghy being towed behind may either ride down a trailing sea and ram the stern of the sailboat, or may be swamped and lost in the trailing sea.

Finally, the towing of the dinghy or pram is objectionable because it acts to decrease the speed of the sailboat. While this decrease in speed is probably not too great, it is an annoyance to the boat's owner who usually is concerned with insuring that his boat is moving through the water as quickly as possible.

Thus it may be seen that the prior methods used to bring a pram or dinghy along when going out in a sailboat of moderate size have been less than satisfactory with the result that some cruises have been put aside and not taken because of the hindrance of attempting to bring a pram or dinghy along.

SUMMARY OF THE INVENTION

It is an object of the present invention to provide a pram so constructed to facilitate its storage aboard a moderately sized sailboat.

A further object of the present invention is to provide a pram or dinghy having a mast receiving well or slot so that the dinghy may be stowed on the deck of a sailboat with the sailboat's mast passing through the well or slot.

Yet another object of the present invention is to provide a dinghy having a mast well and further having a removable plug insertable into the mast well to restore the dinghy's bottom to its conventional configuration, thereby insuring adequate floatation.

The dinghy or pram of the present invention is of generally conventional configuration and may be either a double ended pram or may have a pointed bow. An inwardly extending mast well or slot is formed in a desired portion of the dinghy and, in effect, serves to give the dinghy a generally U-shaped configuration in plan view. When it is desired to stow the dinghy aboard a moderately sized sailboat, i.e. in the range of 18 to 36–40 feet, the dinghy is brought aboard and is positioned aboard the sailboat with the mast of the sailboat being received in the mast well portion of the dinghy. The dinghy is provided with a plug which is insertable into the mast well and retained therein so that, when it is desired to use the dinghy, its conventional bottom configuration will be provided, thereby insuring adequate floatation. The plug may be secured in the mast well by any conventional means and also acts as a seat when in place in the dingly.

As was discussed previously, the towing of a dinghy behind the sailboat is unacceptable for a number of reasons. Since the dinghy in accordance with the present invention is not intended to be towed behind the sailboat but instead is carried on the deck, all of the disadvantages of such towing are eliminated.

Prior attempts to carry the dinghy on the deck of a moderately sized sailboat have met with little success because, as has been set forth hereinabove, the prior arrangements were either cumbersome, required an excess amount of space, or both. In contrast, the present invention provides a dinghy which is storable or carriable on the deck of a sailboat in a manner which takes up little space. Since the mast on most sailboats is located in the center of the boat and approximately one-third of the way back from the bow, the positioning of the dinghy of the present invention with the sailboat's mast passing through the mast well of the dinghy results in the dinghy's stowage centrally on the sailboat, thereby allowing freedom of movement about the boat. The portion of the deck surrounding the mast is usually the least used area of the boat, and the placement of the dinghy in this position results in the carrying of the dinghy in the most convenient manner. The placement of the dinghy in this location does not interfere with the normal setting of the sails and their movement when tacking. Additionally, since the dinghy is stowed in a stable position, straddling the mast, it is relatively easy to secure in place so that it will not shift and slide when the sailboat heels or encounters rough weather.

Thus it may be seen that the dinghy of the present invention is well suited for stowage aboard a moderate sized sailboat without utilizing a large amount of deck space; that the dinghy, with its plug in place, is seaworthy; and that the dinghy is not more expensive or difficult to produce than is a conventional dinghy or pram.

BRIEF DESCRIPTION OF THE DRAWING

While the novel features of the present invention are set forth with particularity in the appended claims, a full and complete understanding of the present invention may be had by reference to the description of a preferred embodiment as set forth hereinafter and as seen in the accompanying drawing wherein in the sole FIGURE there is shown an exploded perspective view of a slot dinghy or pram and plug in accordance with the present invention.

DESCRIPTION OF THE PREFERRED EMBODIMENT

Turning now to the FIGURE, there is shown generally at 10 a slot dinghy or pram in accordance with the present invention. Dinghy 10 is of generally conventional configuration and is comprised of a hull 11 having a bow 12, a stern 14, side walls 16 and 18 and a bottom 20. Extending inwardly from bow 12 is a mast well or slot, generally at 22. A plug, generally at 24, is insertable into mast well or slot 22 for a purpose as will be discussed in more detail hereinafter. While, in the FIGURE, dinghy 10 is shown as having a blunt bow 12 and stern 14, it will be understood that this is meant to be exemplary and that various other conventional boat shapes may also be utilized in the present invention. Additionally, mast well or slot 22 is shown extending inwardly from bow 12 of dinghy 10. Again, this is meant as exemplary, and well 22 could extend into dinghy 10 from any desired portion thereof.

Dinghy 10 is, as was indicated previously, of generally conventional shape and construction and may be of fiberglass, wood, metal or the like. As is seen in the FIGURE, bow portion 12 is generally rectangular, as is stern 14. Sides 16 and 18 are provided with mounting blocks 26, 28 for the receipt of conventional oarlocks (not shown) and bottom 22 is in the shape of a modified V. At the bow of the pram 10 there is located a forward seat 30 and at the stern of the pram 10 there is provided a stern seat 32.

Mast well or slot 22 extends inwardly from a central port 34 on bow 12. Well 22 has a pair of upstanding side walls 36 and 38 and an upstanding rear wall 40. Sides 36 and 38 and end wall 40 are watertightly joined to the bottom 22 of pram 10 and cooperate to form a central aperture or recess 42 extending inwardly from bow 12 into the center of pram 10. As may be seen in the FIGURE, rear wall 40 of slot 22 has a generally vertical upper portion 41 and an inclined lower portion 43 with the inclined portion 43 being angled toward the stern of the dinghy at generally 30°. This shape of rear wall 40 aids in retaining plug 24 in slot 22, and helps prevent water from coming up between the plug 24 and the rear wall 40 into the interior of the dinghy. The 30° angle may be varied, if desired, or rear wall 40 may be vertical or may be angled along its entire length. In the preferred embodiment, pram 10 is approximately nine feet in length with aperture 42 being approximately five feet in length and approximately 10 inches wide. Since dinghy 10 is intended to be stowed on the deck of a sailboat with the sailboat's mast (not shown) passing through aperture 42 of mast well 22, the width of aperture 42 must be sufficient to accomodate the mast.

Plug 24 is as may be seen in the FIGURE, of generally the same length and width as mast well 22 so that plug 24 will fit in aperture 42. Plug 24 includes a front portion 44 having an upwardly extending torque 46, a pair of sides 48 and 50, a rear wall 52, a top 54, and a bottom 56. Rear wall 52 of plug 24 is of the same shape as rear wall 40 of slot 22 and has, in the preferred embodiment, a generally vertical upper portion 53 and an inclined lower portion 55. It will be understood that the shape of rear wall 52 of plug 24 corresponds to the shape of rear wall 40 of well 22. The bottom 56 of plug 24 is so shaped as to be continuous with the remainder of the bottom 22 of dinghy 10 when plug 24 is placed within aperture 42. Plug 24 may be either solid or hollow and may be made of the same material as the remainder of dinghy 10 or may be of complimentary buoyant material. Plug 24 fits into aperture 42 from above, and is held in place by suitable tie rods (not shown) which pass through one or more of a series of holes 58 in side walls 36 and 38 and corresponding apertures 60 in the body of plug 24. When the plug 24 and well 22 are shaped as shown in the FIGURE, only one tie rod need be inserted in an aperture 60 located at the forward end of plug 24. The stern end of the plug will be restrained from upward vertical movement by the engagement of its angled portion 55 with the corresponding inclined surface 43 of the well 22. Alternatively, if plug 24 and well 22 have generally vertical rear walls, several tie rods should be utilized to retain the plug in place. While plug 24 should fit easily into aperture 42, the fit should not be so loose as to allow plug 24 to slide from side to side on the tie rods (not shown).

To insure that water does not pass up between the body of plug 24 and the walls of mast well 22 and into the interior of the dinghy, plug 24 is provided with a lip 62 which extends outwardly from the top 54 of plug 24 and includes outwardly and downwardly extending flanges 64 and 66, respectively. When plug 24 is inserted in aperture 42, lip 62 overlies the tops of side walls 36 and 38 and rear wall 40 of mast well 22 with flanges 66 extending downwardly exteriorly of the side end walls thus preventing water from entering the dinghy. If desired, a rubber gasket or seal (not shown) may be inserted in lip 62 to further improve the seal.

As may be seen in the FIGURE, plug 24 may include a mast step 68 and a and a dagger board well 70 so that, when plug 24 is secured within aperture 42, dinghy 10 may be used for sailing. Alternatively, plug 24, when in place, may be used as a seat with an occupant sitting on top portion 54 of the plug in a position to allow him to row the dinghy.

In operation, assuming it is desired to stow the dinghy on the deck of a larger sailboat, the tie rods (not shown) are removed and plug 24 removed from aperture 42 of well 22 by grasping the tongue 46 and moving the plug upward. Dinghy 10 may now be placed on the deck of the sailboat, either right side up or inverted, with the sailboat's mast (not shown) passing through aperture 42. To prepare dinghy 10 for normal use, plug 24 is placed in aperture 42 and is positioned so that front 44 and bottom 56 of plug 24 are flush with bow 12 and bottom 20, respectively, of dinghy 10, and the upper portions of the side and rear walls 36, 38, and 40 of the well 22 are seated in lip 62 of the plug 24. The tie rods (not shown) are then inserted in holes 58 and apertures 60 and secured, thus securing the plug 24 in place. With plug 24 in place, dinghy 10 is as buoyant as a conventionally configured dinghy of comparable size and may even be more buoyant depending on the material used in plug 24.

Thus it will be seen that there has been hereinabove described a dinghy or pram provided with a mast well or slot which facilitates the stowage of the dinghy on the deck of a sailboat with the sailboat's mast passing through the mast well. While the above description of a preferred embodiment is clear and complete, it will be obvious to one of ordinary skill in the art that a number of changes in, for example, the shape of the dinghy, the shape of the well and plug, the side of the dinghy from which the mast well extends inwardly, the materials used in the construction of the dinghy and the plug, and the type of seal between the plug and the well may be made without departing from the spirit of the disclosed invention and, accordingly, that the scope of the invention be limited only by the following claims.

I claim:

1. A dinghy adapted to be stowable aboard a masted boat, said dinghy comprising:

a hull having exterior sides and a bottom, said exterior sides including a bow, a stern, and side walls;

a mast receiving slot extending inwardly in said hull from one of said exterior sides of said hull; and a plug removably securable in said mast slot whereby said dinghy with said plug removed is stowable aboard said boat with the mast being received in said mast slot.

2. The dinghy in accordance with claim 1 wherein said mast slot includes upstanding side and rear walls, said side and rear walls of said slot extending upwarding from said bottom.

3. The dinghy in accordance with claim 2 wherein said plug includes a bottom portion, said plug bottom being shaped similarly to the portions of said dinghy bottom adjacent said mast slot.

4. The dinghy of claim 2 wherein said plug includes a lip, said lip overlying an upper portion of said side and rear walls of said slot, whereby said plug is sealed in said slot.

5. The dinghy of claim 4 wherein said lip further includes outward and downward extending flanges, said flanges overlying said side and rear walls of said slot.

6. The dinghy of claim 1 further wherein said plug includes a dinghy mast step and a dagger board well whereby said dinghy with said plug secured in said slot may be sailed.

7. The dinghy of claim 1 wherein said plug is of a buoyant material and provides additional flotation when secured in said slot.

8. The dinghy of claim 1 wherein said dinghy is a pram having a generally flat bow.

9. The dinghy of claim 8 wherein said mast slot extends interiorly in said hull from a central port in said bow.

10. The dinghy of claim 9 wherein said plug includes a front portion, said front portion being of similar shape as portions of said bow adjacent said plug when said plug is secured in said slot.

* * * * *